United States Patent [19]

Steinke et al.

[11] Patent Number: 4,498,362

[45] Date of Patent: Feb. 12, 1985

[54] APPARATUS FOR CUTTING THROUGH ROD OR STRAND-LIKE PRODUCTS

[75] Inventors: Hermann O. Steinke; Roland Steinke; Karl-Ulrich Vornfett, all of Hamburg, Fed. Rep. of Germany

[73] Assignee: Justus Technik GmbH Industrie-Anlagen, Hamburg, Fed. Rep. of Germany

[21] Appl. No.: 525,820

[22] Filed: Aug. 23, 1983

[30] Foreign Application Priority Data

Aug. 24, 1982 [DE] Fed. Rep. of Germany ..... 3231825

[51] Int. Cl.[3] ..... B26D 1/29; B26D 3/16; B26D 5/02; B26D 7/06

[52] U.S. Cl. ..... 83/304; 83/337; 83/341; 83/592

[58] Field of Search ..... 83/304, 305, 341, 337, 83/338, 592, 563, 564

[56] References Cited

U.S. PATENT DOCUMENTS 1,914,756 6/1933 Rosler ..... 83/331 X
3,664,397 5/1972 Raye et al. ..... 83/337 X

FOREIGN PATENT DOCUMENTS 239890 5/1960 Australia ..... 83/337

*Primary Examiner*—James M. Meister
*Attorney, Agent, or Firm*—Cushman, Darby & Cushman

[57] ABSTRACT

An apparatus for cutting rod or strand-like products comprised of a rotary holder positioned adjacent the outlet end of a tube from which a water jet is discharged and in which the rod or strand-like products are entrained. The rotary holder includes a plurality of individually actuatable cutting blades movable between cutting and non-cutting positions. An optical scanner determines the presence of dark or discolored areas on the products and generates a signal timed to actuate a sufficient number of cutting blades which will cut through the product as it emerges from the tube and separate the discolored area from the acceptable areas. The cutting blades can be held inoperative by electromagnets and returned by a cam. Alternatively, the blades can include a deflection member and jet nozzles can be employed to pivot the blades in and out of the cutting position.

16 Claims, 11 Drawing Figures

APPARATUS FOR CUTTING THROUGH ROD OR STRAND-LIKE PRODUCTS

BACKGROUND AND SUMMARY OF THE PRESENT INVENTION

The present invention relates to apparatus for the demand cutting of rod or strandlike products, moved individually along a path of motion at a predetermined speed. The apparatus includes a plurality of cutting blades fixed to a rotating holder which is itself arranged adjacent the path of motion. The rotational axis of that blade holder is inclined relative to the longitudinal extension of the path of motion. The cutting blades are movable between cutting and non-cutting positions so that cutting will occur only when required or demanded. Also, the cutting blades are positioned so that the cutting edges of the blades are designed to pass through the products at right angles to the longitudinal extension of the path of motion during the cutting process.

There exist known apparatuses which are used for cutting cigarette rods into individual cigarettes. The feed movement of the cigarette rod and the rotary speed of the cutting blades are adapted to one another in such a way that precisely identically long pieces are always cut from the cigarette rod. The slope of the rotation axis of the support with respect to the longitudinal extension of the path of motion, i.e. with respect to the feed direction of the cigarette rod is selected in such a way that on passing through the path of motion and on separating the cigarette rod, the blades move at the same speed as the rod in the feed direction, i.e. cutting takes place without any acceleration or deceleration of the cigarette rod, but the cutting edges of the blades pass precisely perpendicularly through the rod.

Although such an apparatus is eminently suitable for the continuous cutting through of rod or strand-like articles, it cannot be used if only particular unusable areas are to be cut out or unusable ends cut off from rod or strand-like products. For example, this would be necessary when processing potato sticks, peeled comfrey, peeled carrots, etc., in which unsatisfactory parts, indicated by different coloring, have to be cut away while leaving the satisfactory parts.

For the processing of such products, an apparatus is already known in which the products, e.g. potato chips, are forced through a tube in a water stream flowing at known speed. The tube is transparent or translucent in at least one area, so that corresponding optical scanning arrangements can detect in said area, the presence of points having a differing coloring. By means of a compressed air jet flowing in the transverse direction, a sorting out force is produced at the end of the tube and those elongated articles are removed from the stream of articles which have been found to have a point with a differing coloring.

This known apparatus fulfills the demands made on it with a high output level, but has the disadvantage that it separates the complete article from the conveying area, although only a single, relatively small discolored point is found thereon. It is, therefore, necessary to again process the sorted out articles at a later time, i.e. to cut away or out the discolored points, so that then the remaining parts of the articles can be returned to the previously unsorted articles, or can be used for an inferior purpose.

An apparatus is also already known (DE-OS No. 2,630,930—U.S. Pat. No. 4,114,448) enabling the discolored points on elongated articles, e.g. potato sticks individually moved along a feed trough to be cut out or away and removed with the aid of a double cutting blade having spaced cutting edges in the feed direction, while the remaining part or parts of the article continues to be moved along the feed trough. Thus, by means of this known apparatus, it is possible to remove discolored points from articles, without the articles having such points being removed from the stream of the remaining and completely satisfactory articles and being supplied to a separate working process.

Although this known apparatus relatively reliably and satisfactorily removes the discolored points, it does not permit the processing of larger quantities of elongated articles per time unit in a feed trough. Therefore, the problem was to provide an apparatus for cutting off or out various areas from rod or strand-like articles, while permitting a high throughput of the latter.

According to the present invention, this problem is solved by apparatus where the cutting blades are movable between a working position, in which the cutting edge passes through the products, and a rest position in which the particular cutting blade is outside the range of the path of motion.

Thus, the apparatus according to this invention has blades continuously moving at the desired speed available for the cutting process and when an area to be removed is detected, one or more of the blades is moved from the rest or inoperative position into the working position, so that the blade or blades brought into the working position, which continuing their rotational movement, pass through the product and cut out an area therefrom.

The relatively short pieces that are cut out or off the main product continue to move with that product, but can subsequently be removed from the stream of objects due to their dimensions, e.g. by screening or sieving procedures.

According to a further development of the invention, the blades are fixed in the holder so as to be pivotable about a pivot axis and when the holder rotates, are preferably held in the inoperative or working position by centrifugal force. The pivot axis can be formed by a ball, pressed along a bore, which slopes radially outwards with respect to the rotation axis of the support, into the radially outwardly open blade reception slot within which the blade is positioned and moves.

In such an apparatus the blades, rotating continuously with the support, merely have to be pivoted to pass from the inoperative position into the working position and back again, while the cutting energy is supplied by the rotating support. The formation of the axis by a ball permits a very simple and compact construction, so that it is e.g. possible to place a very large number of blades with a limited spacing on the circumference of a circular support.

To prevent damage to the blades located in the working position, as a result of an excessively high feed or conveying speed of the products, the cutting edge of the blade in the inoperative position can be located in the direction of movement of the products behind the pivot axis of the blade, so that in the case of such an excessive speed, the products pivot the blade out of the working position in the direction of the inoperative position.

The pivoting of the blade from the inoperative position into the working position can take place, e.g. by means of a fluid jet, such as a gas jet. In this case, each blade extends on either side of its axis and the blade side opposite the side having the cutting edge is provided with an impact surface. Adjacent the support and in the direction of the rotation path of the blade, it is possible to provide a nozzle spaced from the path of motion for the articles or products. From such nozzle, a fluid jet is passed in a controlled manner onto the impact or deflection surface of the particular blade and as a result the latter is pivoted into its working position. The impact surface is preferably at right angles at the rotation axis of the support, so that an optimum pivoting action is caused by the fluid jet directed parallel to the longitudinal axis of the support.

In order to move the blade or blades from the working position back into the inoperative position, a return or resetting nozzle can be provided adjacent the support and in the direction of the rotation path of the blades and spaced from the path of motion of the articles or products. The return nozzle also supplies a fluid jet which pivots the particular blade back into the inoperative position, i.e. the return or resetting of the blade can take place in the same way as described herein before in connection with the pivoting of the blade into the working position.

Moreover, instead of the blades being pivotable, they can be constructed so as to move radially with respect to the rotational axis of the support between the working position and the in operative position. In this case, the blades can, for example, be held in the inoperative position by an electromagnet provided on the support and associated within each case one blade. This electromagnet can comprise a coil fixed on or in the support and a ferromagnetic material armature fixed to the blade.

For the return of the blade from the working position, it is possible to provide a cam in the rotation direction of the support and behind the path of motion, which cam constantly varies its spacing from the rotation axis of the support thereby returning the blades to their inoperative position as the cam spacing changes. The cam is positioned so that it engages blades located in the working position. As a result of the configuration of the cam or curve, the blades engaging therewith are consequently returned to their inoperative position.

The cam can be formed by a ring-shaped member positioned eccentrically relative to the support and which moves at essentially the same circumferential speed as the support. Thus, the engagement for the return of the blades takes place by means of part of the ring-shaped member, which is scarcely circumferentially displaced with respect to the blade, i.e. only causes limited abrasive wear.

It has been found that the support can be positioned close to the outlet end of a tube from which passes the water jet in which the products are entrained. Thus, it is this liquid jet that forms the path of motion through which the cutting blades can pass when needed. Accordingly, the products are in fact cut while entrained in the water jet, without impairing its feed movement or the feed movement of the products.

Other objects, features, and characteristics of the present invention as well as the methods and operation and functions of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 5*a* is an elevational view of a cutting blade in its inoperative position;

FIG. 5*b* is a top plan view of FIG. 5*a;*

FIG. 5*c* is an elevational view of a cutting blade in its operating or working position;

FIG. 5*d* is a top plan view of FIG. 5*c.*

DETAILED DESCRIPTION OF THE PREFERRED EMBODIMENTS OF THE PRESENT INVENTION

Figure 1:
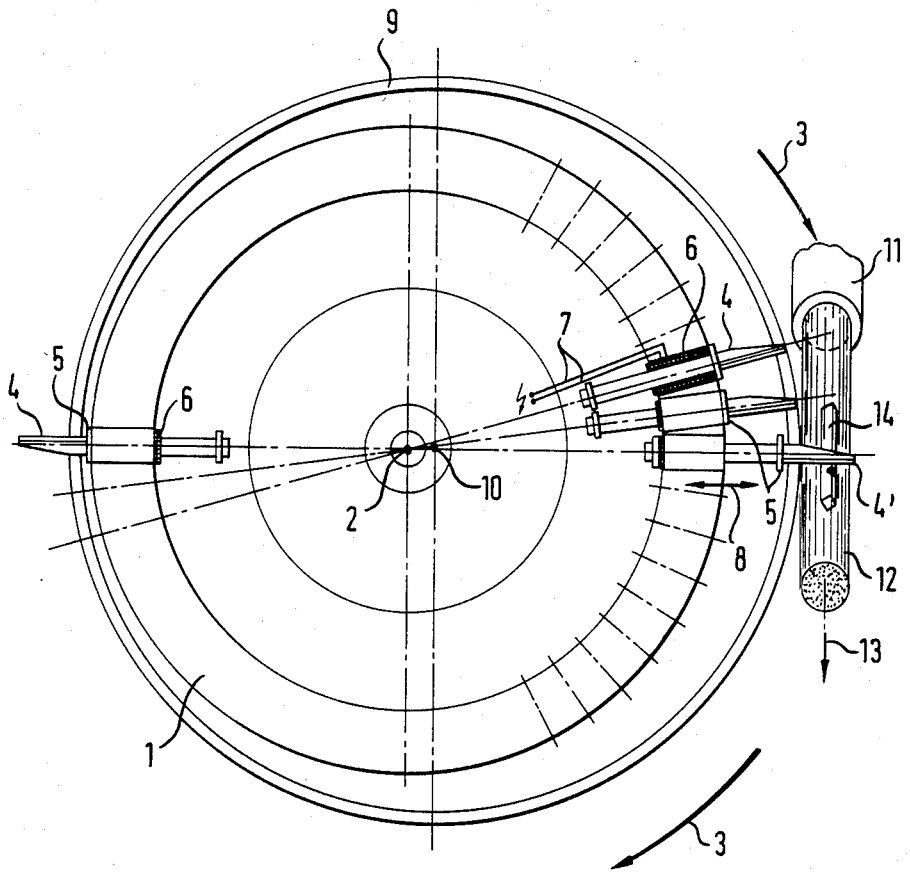
FIG. 1 is a plan view of the apparatus with blades being radially movable with respect to the rotation axis of the support.

Turning first to FIG. 1, the apparatus shown has a holder or support 1 in the form of a disk, which rotates about its central axis 2. Cutting blades are distributed in an uniformly spaced manner around the circumference of the disk, and for clarity only some of these blades are shown, such as at 4, where the blade is in its inoperative condition and 4' where the blade is in its working or cutting positon. These blades 4 and 4' are connected to shafts which extend through coils 6, in each case associated therewith, each of which has a connection 7 to an electric power supply. Only the connection of one coil is shown and the connections can lead to printed conductors (not shown) for sliding contacts, enabling the individual coils to be controlled substantially independently of one another.

An annular armature 5 made from a ferromagnetic material is fixed to each blade. When the blade is in its inoperative position, as at 4, the armature is in direct engagement with the radially outer surface of its associated coil 6 without any interposed air gap therebetween. Thus, the blade has assumed a radially inward position in the direction of arrow 8.

Disk 1 is surrounded by a ring-shaped member 9, which can also be in the form of a disk with a raised circumferential edge and which is rotatable about its own central axis 10. As can be seen in FIG. 1, central axis 10 is spaced from the disk axis 2 so that ring 9 will move eccentrically relative to the rotation axis 2 of disk 1. In FIG. 1, ring axis 10 is in fact displaced to the right of the disk axis 2 by half the distance of the displacement distance of blade 4 between its inoperative position and its working position. Thus, ringshaped member 9, like disk 1, rotates in the direction of arrow 3, with the circumferential speeds of disk 1 and member 9 substantially coinciding.

Adjacent disk 1 and ring-shaped member 9 is a tube 11, from which a water jet 12 in the direction of arrow 13. Water jet 12 is inclined with respect to the rotation axis 2 of disk 1, as can in particular be gathered from FIGS. 3 and 4. The water jet is used for transporting the articles to be cut, e.g. potato sticks 14 or other rod or rod like articles from which portions will be cut.

During the operation of such an apparatus, the articles, such as potato sticks transported by the water jet 12 within tube 11, are optically checked or inspected for the appearance of discolored portions, as is e.g. known from the aforementioned apparatus, in which spotted articles, e.g. potato chips, are sorted out by means of a compressed air jet flowing in the transverse direction. If this optical inspection reveals a discolored area, a corresponding control signal is produced, with the aid of which the exciting current for one or more coils 6 of inoperative blades 4 is interrupted. Due to this interruption of the exciting current, the holding power for the corresponding blade or blades is eliminated and the blade or blades are displaced radially outwards by the centrifugal force acting in the direction of arrow 8 and as shown for blade 4' in FIG. 1 the blade then moves to its working or cutting position. The radially outward movement is limited by the engagement of armature 5 on the ring-shaped member 9. While taking account of the time necessary to enable the discolored area of the potato stick to move from the optical scanner to the cutting position of blade 4' indicated in FIG. 1, the blade or blades will controllably be brought into the working position and cut out or off the discolored area of the potato stick shortly upon its emerging from the end of tube 11.

As blades 4' in the working position according to FIG. 1 are moved further in the direction of arrow 3, together with disk 1, armatures 5 slide along the interior surface of ring 9. As the distance between the disk circumference and the ringshaped member 9 becomes gradually smaller, the blades are gradually moved radially inwards in the direction of the central axis 2 when each blade has rotated to a point diametrically opposite so that, on the cutting point, it will have moved radially inwardly so that armature 5 will engage coil 6 and be held by the latter through the exciting current for the coil which will have been switched on again in the meantime. The blade will now be in its inoperative position.

The apparatus shown in FIGS. 2 and 4, once again includes a holder or support in the form of a disk 21 which rotates about axis 22. Mounted on the periphery of disk 21 are a plurality of equidistantly spaced and preferably plastic cutting blades shown at 24 in an inoperative position and at 24' in their working or cutting position. The inoperative position is shown in FIG. 5*a* while the working, cutting or operating position is shown in FIG. 5*b*. As will be described hereinafter, pivoting of the cutting blades from their inoperative to their operative position takes place by means of a nozzle 25, from which a fluid is discharged, such as gas, water or a compressed air jet containing water droplets. The application of this fluid jet will cause the pivoting of the blade from the inoperative position (blade 24 in FIG. 4) into the working position (blade 24' in FIG. 4).

Figure 2:
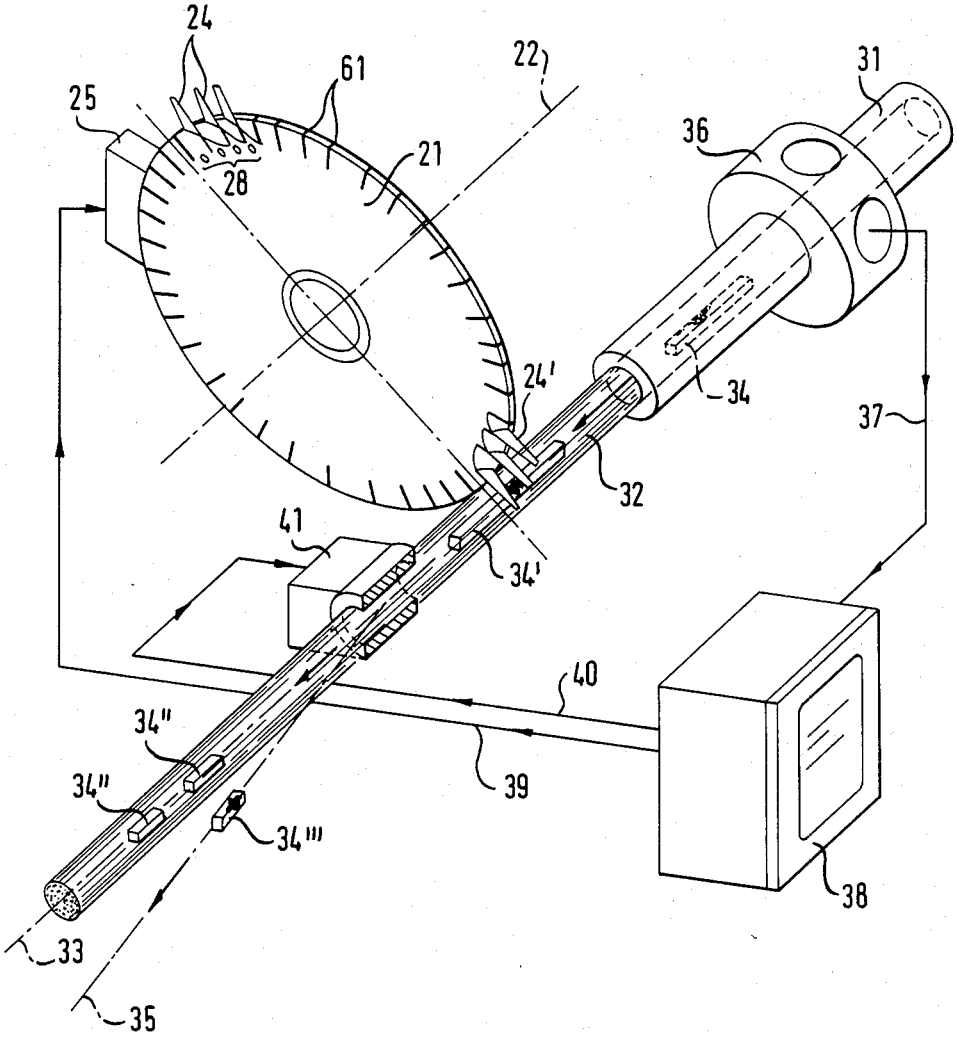
FIG. 2 is a diagrammatic, perspective view of the apparatus with the blades being pivotally mounted on the holder.

A conveying water jet 32, discharged from a tube 31 and moving along axis 33 runs adjacent disk 21 as shown in FIG. 2. This water jet conveys consecutive single potato sticks 34. An optical scanner 36 is provided which, on the passage of a potato stick therepast, checks for the presence of dark or discolored areas. If such a dark area is detected, as is e.g. present on potato stick 34, then a corresponding signal is generated by the scanner and supplied by means of line 37 to the diagrammatically represented evaluation circuit 38 as for instance used in a color sorting machine manufactured by ESM Operation Geosource Inc.) Houston. By means of line 39, this signal controls the output of fluid from nozzle 25, so that when the dark point appears on stick 34, one or more blades 24 as needed to cut out or cut up the discolored area will be pivoted and moved into the immediate vicinity of the circumferential edge of disk 21 so as to pass through the water jet. Thus, they are titled into their working position, as is indicated in connection with stick 34' and blade 24'. This can be achieved without difficulty, because the flow rate or speed of the water jet 32, the conveying speed of the stick and the circumferential speed of disk 21 are all known factors.

It is also pointed out that the release of the fluid jet from nozzle 25 can additionally be controlled in such a way that it precisely takes place when the blade to be pivoted is positioned in front of the nozzle, i.e. not between two blades for example. For this purpose, the disk 21 can contain holes, diagrammatically shown at 28 in FIG. 2, associated with each of the individual blades 24 and through which can pass light for a photo-electric device. Thus, the fluid jet is always released in response to the passage of light and the resulting activation of the photoelectric device.

The activated or pivoted blades in the working position will cut through the potato stick and if the dark point is located in a central area, at least two cuts are made, namely one in front and another behind the dark area. By means of an activation signal from circuit 38 carried by line 40, it is then possible to actuate a downstream blow-out device 41 that employs a compressed air jet to deflect the cut-out portion 34''' containing the dark area from the confines of the transporting water jet 32, so that portion 34''' thereafter moves along a different path 35. The remaining stick portions 34'', which do not have any dark points, continue to move with water jet 32 along its axis 33. However, it is pointed out that it is not absolutely necessary for the parts of the potato stick containing the dark spots to be deflected from the water jet 32. In many cases, it is easier to cut up the area having dark spots with the aid of successive blades in the working position and the resulting small fragments can thereafter be removed mechanically, e.g. by sieves or screens from the total potato stick supply.

As stated hereinbefore, the axis of the disk carrying the blades slopes (is inclined) with respect to the longitudinal axis of the tube 31 and consequently with respect to the water jet 32. This is more particularly visible in FIG. 4, which is a partial view of the apparatus of FIG. 2. As a result of this inclined position, blades 24' (in their working position), on rotating disk 21 which is moving in the direction of arrow 23, and consequently adjacent water jet 32 in the direction of arrow 23', are moved with their cutting edges at right angles with respect to axis 33 of the water jet and, likewise, at right angles through the potato sticks 34, 34'.

Figure 3:
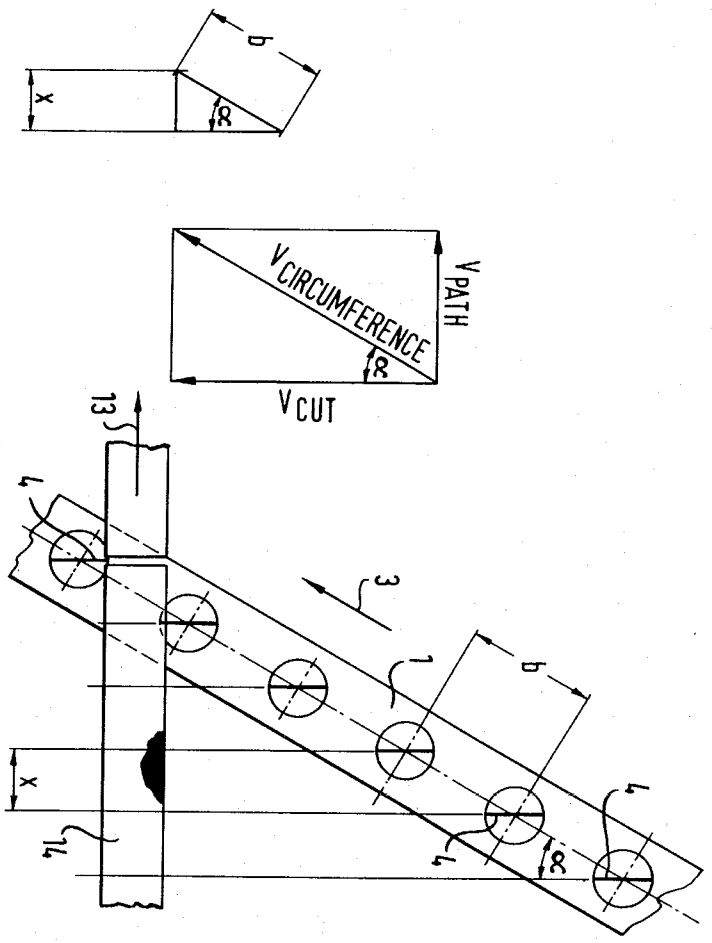
FIG. 3 shows the geometrical relationships between the feed speed of the products to be cut and the cutting speed of the blades.

This relationship between the inclined position of the rotation axis of the disk and the longitudinal axis of the water jet is shown in FIG. 3. Disk 1, from the apparatus of FIG. 1, is inclined at an angle $\alpha$ (e.g. 26°) with respect to the longitudinal axis 13 of the water jet, while blades 4 are at right angles to axis 13. The distance between the blade centers is "b" (e.g. 17 mm) and the distance between the projection of two adjacent blades on axis 13 is "x" (e.g. 7.5 mm). When the circumferential area of disk 1, adjacent axis 13, moves in the direction of arrow 3 at speed v (circumference) (e.g. 22.8 m/sec), then blades 4 pass at speed v (cut) (e.g. 20.5 m/sec) through the water jet, which moves at speed v (path) (e.g. 10 m/sec). To ensure that blades 4 pass through the water jet and consequently through the products to be cut in such a way that there is no acceleration or deceleration of the jet and/or product, in the case of a given inclination angle $\alpha$, the ratio of v (circumference) to v (path) must be equal to the ratio of b:x. If this ratio is not respected, then there is either an acceleration or a deceleration of the water jet, together with the product contained therein, which comes in engagement with the blade.

Figure 4:
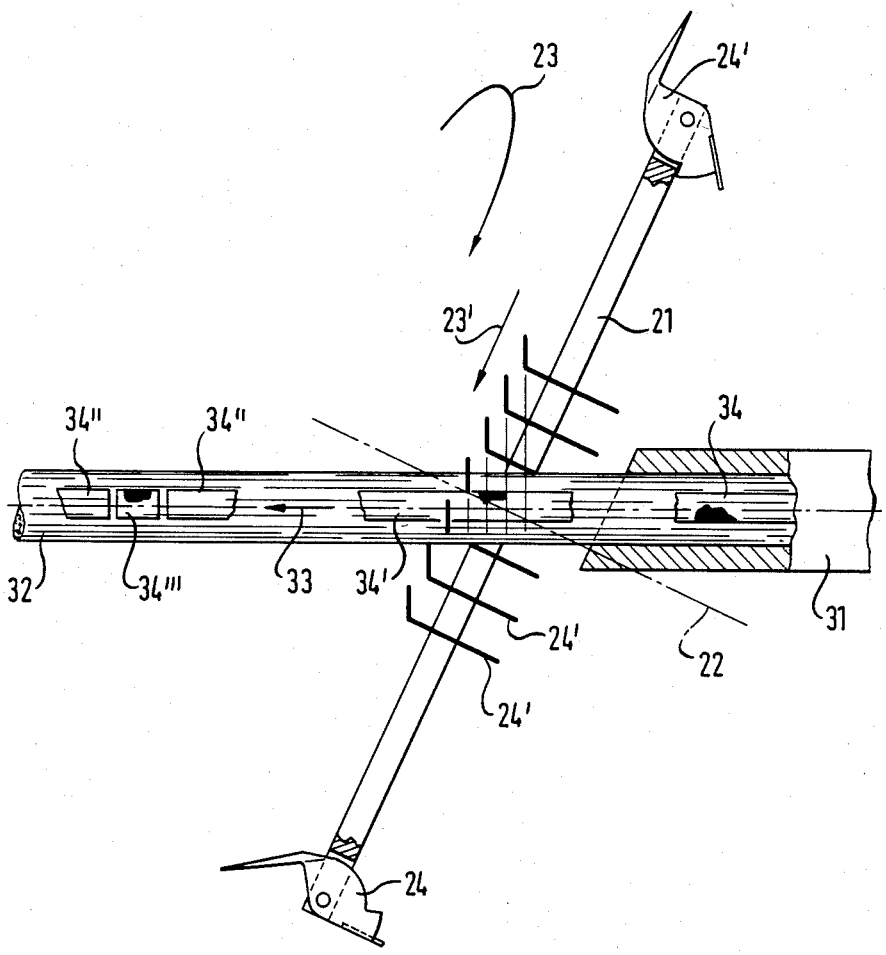
FIG. 4 is a greatly simplified side view of a portion of the apparatus shown in FIG. 2.
Figure 5A:
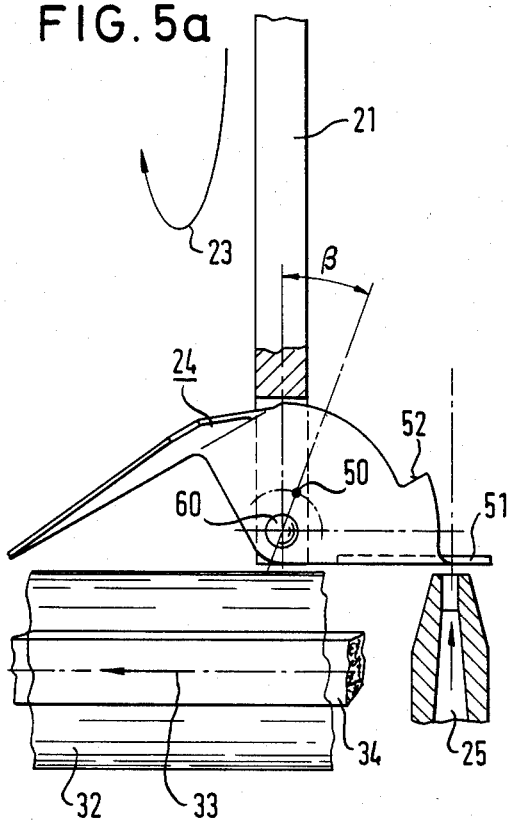
FIGS. 5*a*–5*d* comprise several partial representations of the blade assembly.
Figure 5C:
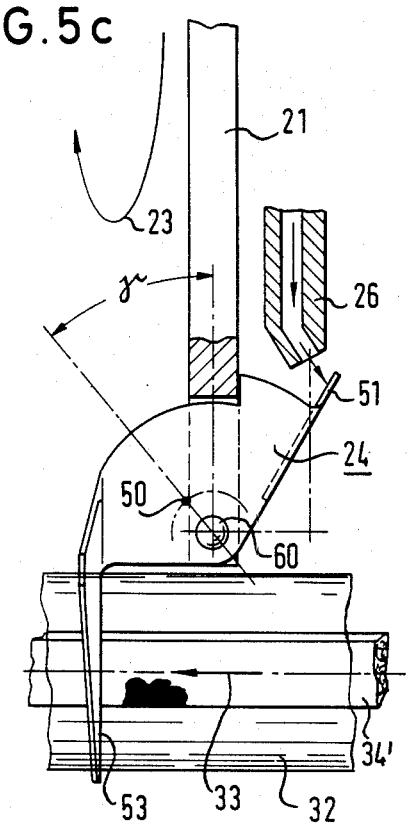
Figure 5B:
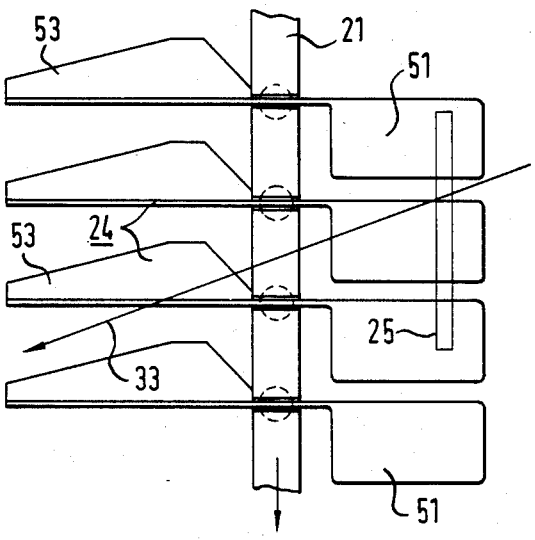
Figure 5D:
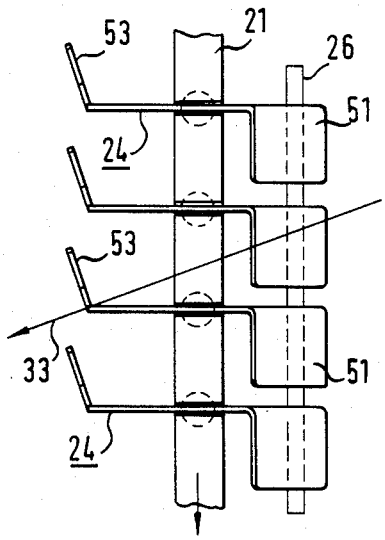

The shape and arrangement of the blades and the apparatus according to FIGS. 2 and 4 are shown in detail in FIGS. 5*a*–5*d*, a single blade 24 being shown in FIGS. 5*a* and 5*c*. These blades are placed in radially directed slots and pivotably about balls 60 serving as pivot axes in disk 21. The blades are held in their inoperative position in such a way that they are located outside the range of water jet 32 and their center of gravity 50 is located on a straight line, which intersects the median radial plane of disk 21 with an angle $\beta$. On rotating disk 21 in the direction of arrow 23, the centrifugal force consequently brings about a clockwise torque (FIG. 5*a*), i.e. blade 24 is firmly engaged on the right-hand side of disk 21 ($\Delta$ FIG. 5*b*), so that a stable inoperative position is obtained. Blades 24 carry impact surfaces 51 which, in the inoperative position, are parallel to the rotation axis of disk 21 and are, therefore, at right angles to the discharge orifice of nozzle 25. As is shown in FIG. 5*b*, nozzle 25 extends over several impact surfaces or over a plurality of blades, so that a fluid jet is simultaneously directed against that grouping of several blades. Alternatively, a single blade could be exposed to the action of the fluid over a larger rotary area.

If a blade 24 is subject to the action of a fluid jet from nozzle 25, it is pivoted counterclockwise until shoulder 52 engages on disk 21 as is the case in FIG. 5*c*. In this position, the center of gravity 50 is located on a straight line, which intersects the median radial plane of disk 21 at an angle $\gamma$, i.e. the blade has been pivoted counterclockwise by the angle $(\beta+\gamma)$. This angle $\beta+\gamma$ can be smaller than 90°, due to the downstream off-set position of that part (53) of blade 24 carrying the cutting edge. In this center of gravity position, the centrifugal force on blade 24 produces a counterclockwise torque (FIGS. 5*a* and 5*c*), through which the blade 24 is stably held in the operating position. In this position, the cutting edge 53 of blade 24 is moved through water jet 32 and the products 34 contained therein.

If the speed of disk 21 has not been correctly adapted to the flow rate of water jet 32 and in particular if the latter has too high a flow rate, a force is exerted on the cutting area of blade 24, so that the blade is pivoted counterclockwise, due to the position of the pivot axis 60 in the flow direction 33 in front of the cutting area of the blade. This prevents excessive flow rates damaging the blades.

As can be gathered from FIGS. 5*a* and 5*c* on pivoting the blade between its inoperative and operative positions, there is only a slight radial displacement of center of gravity 50 with respect to disk 21, so that the pivoting action only leads to a slight unbalance.

For returning the blade from the working position into the inoperative position, FIG. 5*c* shows a nozzle 26 which, on the side of impact surface 51 facing the side subject to the action of nozzle 25, deflects another fluid jet and consequently the blade in the working position can be pivoted back into its inoperative position. The position of nozzle 26 is indicated in phantom in FIG. 7 and as a result thereof, the blades in the working position are pivoted back into their inoperative position after passing through water jet 32.

Figure 6B:
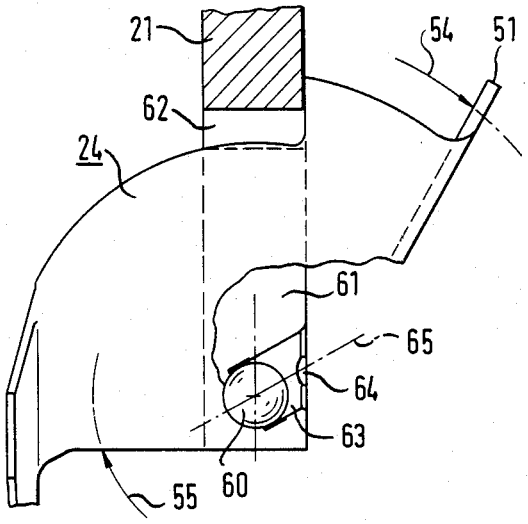
Figure 7:
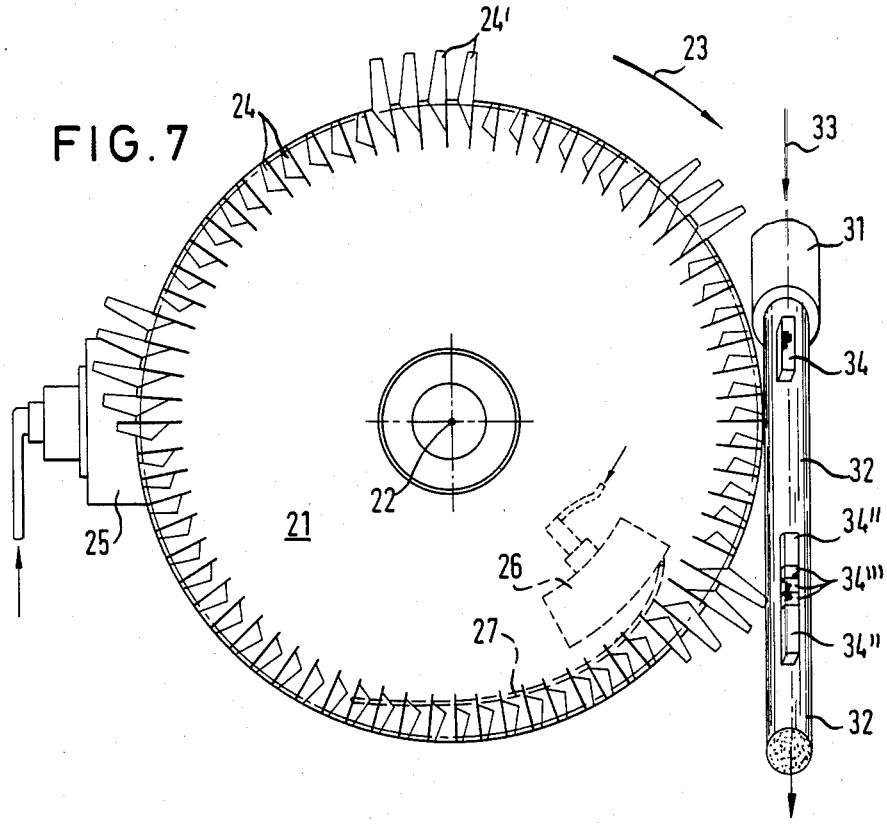
FIG. 7 is a diagrammatic view, similar to FIG. 1, of the apparatus with pivotable blades and the indicated devices for returning the blades to their inoperative position.

With reference to FIG. 7, a stationary cam 27 could alternatively be used for returning the blades, instead of using nozzle 26. Cam 27 continuously increases its distance on the rotation direction from the rotation axis of disk 2, as well as from its lower surface in FIG. 7 and consequently by engagement with the outer areas of impact surfaces 51 of blades 24 in the working position, the blades are returned to their inoperative position. This engagement area of the impact surface is indicated by an arrow 54 in FIG. 6*b*. A further arrow 55 shows another engagement area for a cam.

Figure 6A:
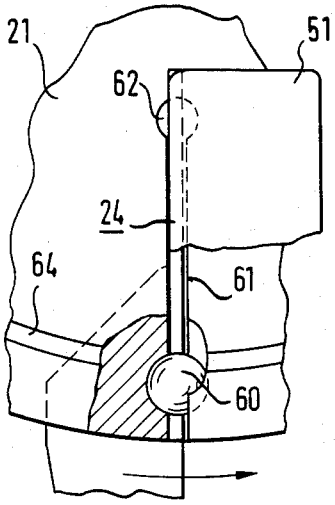
FIGS. 6*a* and 6*b* show two partial representations of the mounting of the pivotable blades in the support as seen from the front and side, respectively.

FIGS. 6*a* and 6*b* show the construction of the swivel bearings for blade 24. As stated before, blades 24 are arranged in radially, outwardly opening slots 61 in disk 21. Slots 61 are widened at their inner end by a transverse bore 62 forming the slot bottoms and which reduces the notch effect. The slot has a sloping bore 63, whose central axis 65 is directed to slope radially outwardly relative to disk 21 from the opening of the bore in the direction of its bottom surface. The bottom surface of bore 63 is widened and a steel ball 60 is pressed down into the bottom of the bore so that it can freely rotate therein and form the pivot axis of blade 24. Since bore 63 slopes radially outwards, the centrifugal force, when disk 21 rotates, presses ball 60 into the bottom of the bore and is consequently reliably held in the disk.

The disk 21 carries an annular slot 64, which intersects the median axes 65 of all the bores 63. This annular slot is used for simplifying the fitting of the steel balls, because the latter are placed in slots 64 and from it can be pressed into bores 63.

It is pointed out that at the swivel connection, blades 24 have a bore and that the particular blade, together with the sleel ball 60 located in its bore, is inserted in slot 61 of disk 21.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

What we claim is:

1. Apparatus for cutting through rod or strand-like products, comprising means for moving said products individually in a predetermined direction and at a predetermined speed thereby defining a path of motion for said products, said apparatus having a plurality of cutting blades, each provided with a cutting edge, said blades being pivotally fixed to a rotary holder arranged adjacent the path of motion and whose rotation axis is inclined relative to the longitudinal extension of the path of motion so that said cutting edges pass through the products at right angles to the longitudinal extension of the path of motion during the cutting process, wherein said cutting blades are movable between a working position, in which the cutting edges pass through the products, and an inoperative position, in which such a blade is outside the path of motion and means for driving and controlling said apparatus.

2. Apparatus according to claim 1, wherein said cutting blades are fixed in said holder so as to pivot about a pivot axis.

3. Apparatus according to claim 2, wherein the cutting edge of each of said plurality of cutting blades located in the inoperative position is positioned behind said pivot axis in the direction of movement of the product.

4. Apparatus according to claim 1, wherein blades are held by centrifugal force in their operative and inoperative positions.

5. Apparatus according to claim 2, wherein said rotary holder includes means defining a plurality of radially outwardly opening blade reception slots spaced about the periphery thereof, each for receiving one of said plurality of individual cutting means therein.

6. Apparatus according to claim 5, wherein said rotary holder includes means defining a plurality of inwardly extending bores within said slots and a ball member positioned within said bore, said ball member defining said pivot axis.

7. Apparatus as in claim 6, wherein each of said bores slope radially outwardly with respect to rotation axis of said rotary holder and into the radially outwardly opening blade reception slot.

8. Apparatus according to claim 2, wherein said cutting edge is positioned on one side of said pivot axis and said cutting blade further includes a deflection member positioned on the other side of said pivot axis and nozzle means positioned adjacent said holder for directing a fluid jet against said deflection member to pivot said cutting blade into the working position.

9. Apparatus according to claim 8, wherein the deflection member includes an impact surface aligned to be parallel to the rotation axis of said holder when said cutting blade is in its inoperative position.

10. Apparatus according to claim 8, further including return nozzle means positioned adjacent said holder and spaced from said path of motion for supplying in a controlled manner a fluid jet against said deflection member to pivot the particular blade back to the inoperative position.

11. Apparatus according to claim 1, wherein said blades can in each case be moved between the working position and the inoperative position radially with respect to the rotation axis of said holder.

12. Apparatus according to claim 11, further including electromagnet means for holding said cutting blades in their inoperative positions.

13. Apparatus according to claim 12, wherein said electromagnet means comprises a plurality of electromagnets one of which is associated with each of said radial blades, each of said electromagnets including a coil secured to said holder and wherein each of said cutting blades includes a ferromagnetic armature fixed thereto.

14. Apparatus according to the claim 1, further including cam means for engaging said cutting blades in the working position and for returning such blades back to an inoperative position, said cam means being positioned about said holder and behind the path of motion so that in the rotation direction, said cam means constantly modifies its distance from the rotation axis of the support.

15. Apparatus according to claim 14, wherein said cam means comprises a ring-shaped member, arranged eccentrically with respect to said holder and which rotates with substantially the same rotation speed as said holder.

16. Apparatus for cutting through rod or strand-like products comprising means for moving said products in a predetermined direction and at a predetermined speed thereby defining a path of motion for said products, said apparatus further including a plurality of individual cutting means for cutting through said products, each of said cutting means being movable between cutting and non-cutting positions, rotary holder means for supporting said plurality of cutting means so that each of said cutting means is movable between cutting and non-cutting positions, means for moving each of said cutting means between their cutting and non-cutting position whereby individual ones of said plurality of cutting means are moved into a cutting position only at predetermined instances, said rotary holder means having an axis of rotation inclined at a predetermined angle to said path of motion with each of said individual cutting means being positioned on said rotary holder means so that each of said individual cutting means passes through said products at a right angle to said path of motion when said individual cutting means is in its cutting position.

* * * * *